US005758714A

United States Patent [19]

Sato et al.

[11] Patent Number: 5,758,714

[45] Date of Patent: Jun. 2, 1998

[54] METHOD OF AUTOMATICALLY POURING MOLTEN METAL AND APPARATUS THEREFOR

[76] Inventors: Jiro Sato, 1301, Goshikien 3-chome, Nisshin-shi, Aichi-ken; Kenitsu Yoshida, Naruoka 2-2605, Midori-ku, Nagoya-shi, Aichi-ken; Kouichi Banno, 1114, Kaguyama 2-chome, Nisshin-shi, Aichi-ken, all of Japan

[21] Appl. No.: 632,702

[22] Filed: Apr. 15, 1996

[30] Foreign Application Priority Data

Apr. 19, 1995 [JP] Japan ..... 7-119296
Jul. 6, 1995 [JP] Japan ..... 7-194208

[51] Int. Cl.[6] ..... B22D 37/00

[52] U.S. Cl. ..... 164/457; 164/136

[58] Field of Search ..... 164/136, 337, 164/457, 155.4; 222/604

[56] References Cited

U.S. PATENT DOCUMENTS 5,381,855 1/1995 Mezger ..... 164/136

FOREIGN PATENT DOCUMENTS 6-7919 1/1994 Japan ..... 222/604

*Primary Examiner*—Kuang Y. Lin

[57] ABSTRACT

A ladle is rotationally tilted around its rotation shaft and the rotation center of the rotation shaft is moved along a locus deviating from the predetermined arc locus with its center at an imaginary initial pouring center which is set at or adjacent to a molten metal falling start point in the pouring spout of the ladle and, at the same time, the imaginary initial pouring center of the spout is moved while maintaining a fixed relationship with the rotation center of the rotation shaft, whereby the molten metal is poured to a fixed position in the pouring cup of the mold.

5 Claims, 9 Drawing Sheets

PRIOR ART

PRIOR ART

METHOD OF AUTOMATICALLY POURING MOLTEN METAL AND APPARATUS THEREFOR

BACKGROUND OF THE INVENTION

1. Field of the Invention

The present invention relates, generally, to molding technology, and, more particularly, to a method and an apparatus for automatically pouring molten metal into a fixed position in a pouring cup of a mold, even when the pouring rate and velocity of the molten metal from a ladle to the mold varies as the ladle tilts, or even when the pouring flow line of the molten metal from the ladle to the mold varies due to characteristics (e.g., wetting property, viscosity, etc.) of the molten metal.

2. Prior Art

Conventionally, in a molding factory, the operation of pouring molten metal into a mold is greatly dependent upon the intuition and skill of experienced workers. The molten metal is poured from a melting furnace into a ladle (which is typically roughly cylindrical in shape and is equipped with a spout at a top end) and is conveyed to a pouring section or a position where molds are arranged. As the ladle is generally supported by hanging means, an operator is required to rotationally tilt the ladle to pour the molten metal into a pouring cup of each of the molds. In this case, the ladle spout and each pouring cup are separated by a certain distance, which distance varies along with the rotational tilting motion. Moreover, as the ladle is tilted, the surface area of the molten metal varies in the ladle. Thus, when the ladle is tilted at a constant velocity, the quantity of the poured molten metal varies gradually. Accordingly, in order to correct for variation in the distance between the pouring spout of the ladle and each pouring cup and for variation in the poured quantity, the operator must conduct an operation for adjusting the positional relationship of the pouring spout of the ladle to each pouring cup of the mold and, at the same time, an operation for adjusting the rotational tilting angle of the ladle while observing the pouring flow line curve of the molten metal. These operations are extremely difficult and require sophisticated techniques. These operations are also very dangerous.

Attempts have been made to automate the pouring operation. In particular, to allow the spout position of the ladle to vary along with the tilting motion of the ladle, as shown in FIG. 5, a method has been suggested in which an intermediate gutter 200 is positioned between the ladle 1 and the mold 100, and the ladle 1 is rotationally tilted around its rotation shaft 4 to thereby supply the molten metal L from the ladle 1 to the intermediate gutter 200 and then to pour the molten metal L into the pouring cup 100*c* of the mold.

According to the method mentioned above, while it is not necessary to adjust the correlational position of the pouring spout, 2 of the ladle to the pouring cup 100*c* of the mold, problems are caused in that defective products are generated due to the temperature drop of the poured molten metal and the fluctuation of the pouring flow line of the molten metal due to adhesion of slag. Moreover, the maintenance and replacement of the intermediate gutter 200 is inevitably required.

In light of the above-described problems, the present inventors devised a method of pouring molten metal using a ladle 1 which has a sector shape in a longitudinal section passing the pouring spout 2 so that the surface area (S=S1+S2) of the molten metal L in the ladle 1 is substantially constant during the pouring. This method of pouring molten metal using the sector-shaped ladle (shown in Japanese Patent Application Publication No. 52-9580 and illustrated in FIGS. 6 and 7 of this patent application) has advantages in that, irrespective of the rotational angle of the ladle 1, the pouring of the molten metal can be accomplished while maintaining the correlational position of the molten metal falling start point in the pouring spout 2 and the pouring cup 100*c* in the mold constant, that is, without varying 1 and h (FIG. 7), and thereby without varying the pouring flow line T of the molten metal between the ladle 1 and the pouring cup 100*c*.

However, with such a sector-shaped ladle 1, it is necessary to tilt the ladle about the axis passing the pouring spout 2 of the ladle 1. Therefore, the rotation support axle and the related drive mechanisms are concentratedly allocated around the pouring spout 2. Accordingly, when it is desired to pour the molten metal under the condition that the pouring spout 2 of the ladle and the pouring cup 100*c* of the mold are very closely positioned, such a construction may not be adopted.

After painstaking research, the inventors have discovered that, in the case of the sector-shaped ladle 1 as described above, even if the variation in shape of the pouring spout of the ladle according to the tilting motion of the ladle may be disregarded, when the tilting of the ladle increases to make the inclined front wall of the ladle approach a horizontal position, the velocity of the molten metal which is horizontally poured toward the pouring spout increases as the ladle is tilted, so that the molten metal tends to fall farther in the direction apart from the ladle.

Referring now to the pouring spout, in the case where the tilting angle of the ladle is small, the distance along which the molten metal contacts the wall of the pouring spout is long. On the other hand, when the tilting angle is large, the distance along which the molten metal contacts the wall of the pouring spout is short. Accordingly, when the wetting property between the molten metal and the ladle (i.e., the affinity between the molten metal and the refractory material) is good, the molten metal tends to fall in the direction approaching the ladle from the mold as the tilting angle increases. These phenomena are also largely affected by the viscosity of the molten metal.

As a result of their extensive research and experimentation with the sector-shaped ladle, the inventors have found that, even with the sector-shaped ladle, it is difficult to pour the molten metal into the fixed position in the pouring cup of the mold because the pouring flow rate and the pouring flow velocity of the molten metal from the ladle to the mold vary as the ladle is tilted, or, because the pouring flow line of the molten metal from the ladle to the mold varies due to the characteristics (e.g., wetting property, viscosity, etc.) of the molten metal. The present invention is based on the new findings by the inventors.

Therefore, it is an object of the present invention to provide a method and an apparatus for automatically pouring molten metal into the fixed position of the pouring cup of the mold, even when: (a) the pouring spout of the ladle and the pouring cup of the mold are very close to each other; (b) the pouring flow rate and the pouring flow velocity of the molten metal from the ladle to the mold vary as the ladle is tilted, and (c) the pouring flow line of the molten metal from the ladle to the mold varies due to the characteristics (wetting property or viscosity) of the molten metal.

SUMMARY OF THE INVENTION

The above object is attained by the present invention which resides in a method of pouring molten metal into a mold by tilting a ladle containing the molten metal, the method characterized in that the ladle has a rotation shaft and is rotationally tilted about the rotation shaft, and a rotation center $O_1$ of the rotation shaft is moved along a locus ($R_1$ or $R_2$) deviating from a predetermined arc locus with its center at an imaginary initial pouring center O which is set at or adjacent to a molten metal falling start point in a pouring spout of the ladle when pouring of the molten metal begins, and, simultaneously, the imaginary initial pouring center O of the spout is moved while maintaining a fixed relationship with the rotation center $O_1$ of the rotation shaft, whereby the molten metal is poured to a fixed position in a pouring cup of the mold, even though the pouring flow line of the molten metal varies as the ladle moves.

Preferably, the ladle is rotationally tilted about the rotation shaft and driven in a vertical direction and in a horizontal direction to thereby move along the predetermined locus. Further, the imaginary initial pouring center O of the spout is moved downward to approach the mold until the ladle is tilted at a predetermined angle about the rotation shaft after the start of pouring of the molten metal, and then moved in a horizontal direction to depart from or come close to the mold. More specifically, in the case where the influence of the horizontal pouring velocity is more than that of the wetting property, the rotation center $O_1$ of the rotation shaft is moved along the locus ($R_1$) deviating outward from the predetermined arc locus (R) which has its center at the imaginary initial pouring center O of the spout, and, simultaneously, the imaginary initial pouring center O of the spout is moved downward to approach the mold until the ladle is rotationally tilted at the predetermined angle about the rotation shaft after the start of pouring of the molten metal, and then is moved in a horizontal direction ($H_1$) to leave the mold. In the case where the influence of the horizontal pouring velocity is less than that of the wetting property, the rotation center $O_1$ of the rotation shaft is moved along the locus ($R_2$) deviating inward from the predetermined arc locus (R) which has its center at the imaginary initial pouring center O of the spout, and, simultaneously, the imaginary initial pouring center O of the spout is moved downward to approach the mold until the ladle is rotationally tilted at the predetermined angle about the rotation shaft after the start of pouring of the molten metal, and then is moved in a horizontal direction ($H_2$) to approach the mold.

The above method of pouring molten metal is satisfactorily carried out by an apparatus which comprises a ladle for containing molten metal, the ladle having a rotation shaft, drive means for rotationally tilting the ladle around the rotation shaft, and control and drive means for moving the ladle in a vertical direction and in a horizontal direction in such a manner that a rotation center $O_1$ of the rotation shaft of the ladle is moved along a locus ($R_1$ or $R_2$) deviating from a predetermined arc locus with its center at an imaginary initial pouring center O which is set at or adjacent to a molten metal falling start point in a pouring spout of the ladle when the pouring of the molten metal begins, and, simultaneously, the imaginary initial pouring center O of the spout is moved while maintaining a fixed relationship with the rotation center $O_1$ of the rotation shaft, whereby the molten metal is poured into a fixed position in a pouring cup of the mold, even though the pouring flow line of the molten metal varies as the ladle moves.

DETAILED DESCRIPTION OF THE PREFERRED EMBODIMENTS

Figure 1:
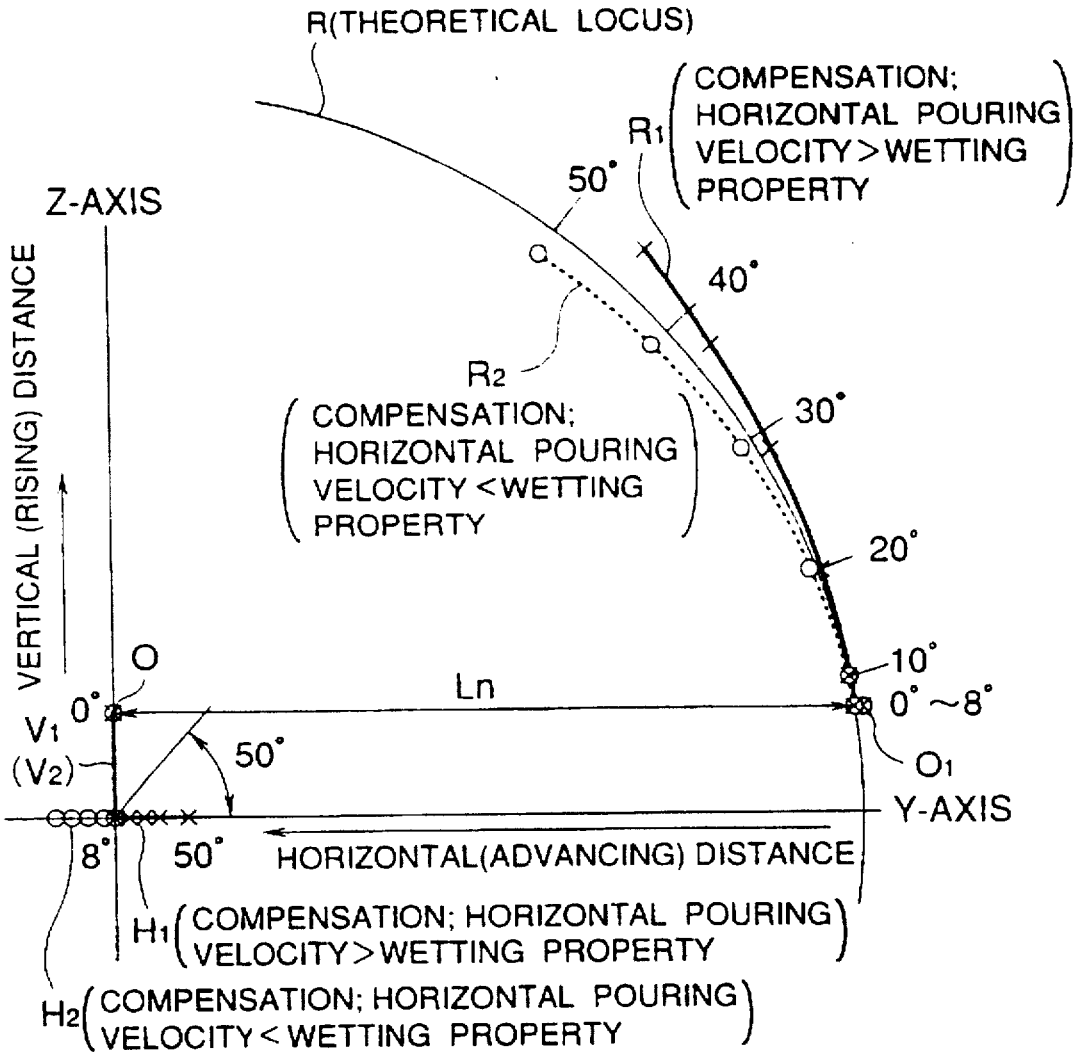
FIG. 1 is a graphical representation illustrating a method of pouring molten metal according to the present invention.

Referring now to the drawings, the method of automatically pouring molten metal and the apparatus according to the present invention will be described.

EXAMPLE 1

Figure 2:
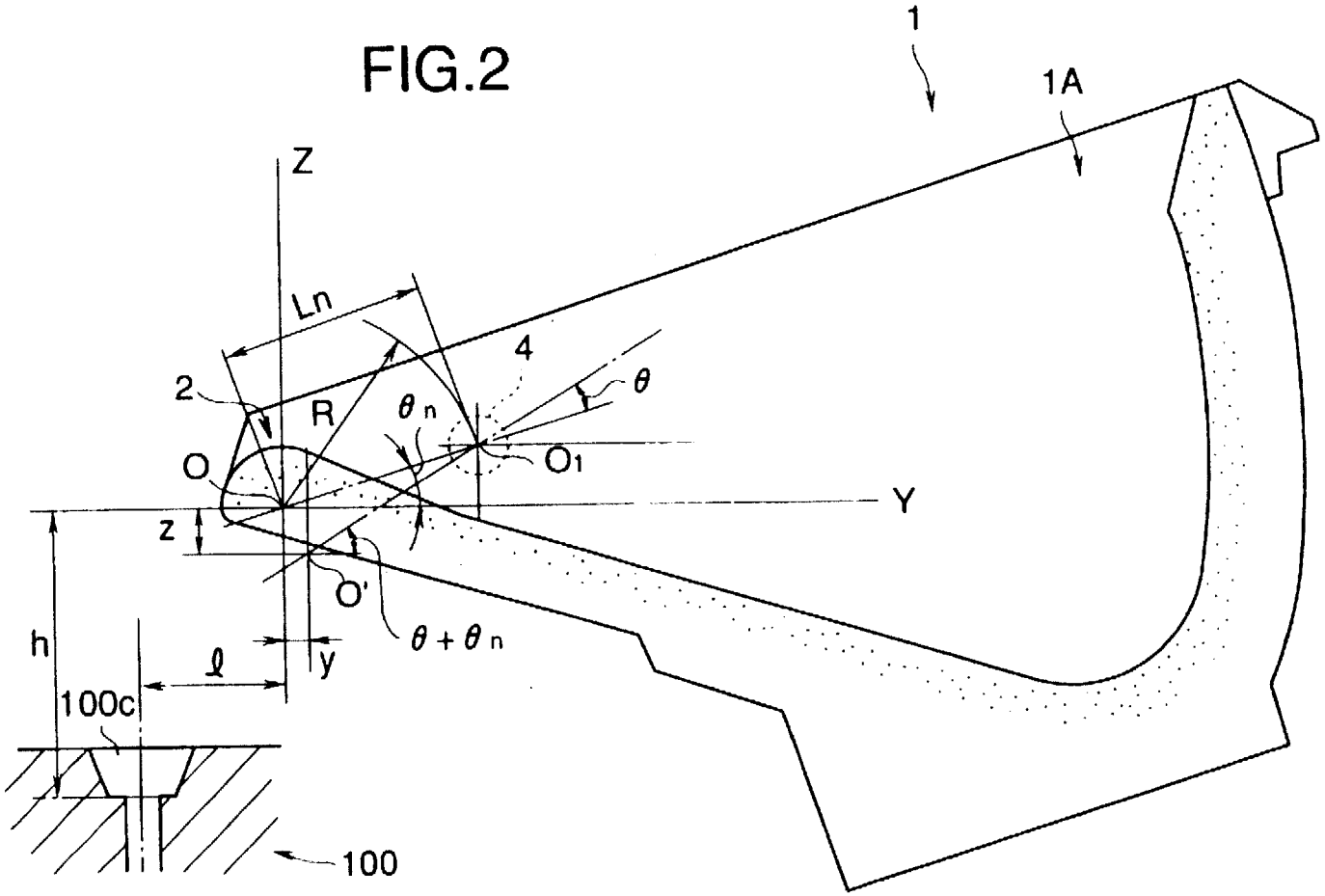
FIG. 2 is a view illustrating a principle of a method of pouring molten metal according to the present invention.
Figure 3:
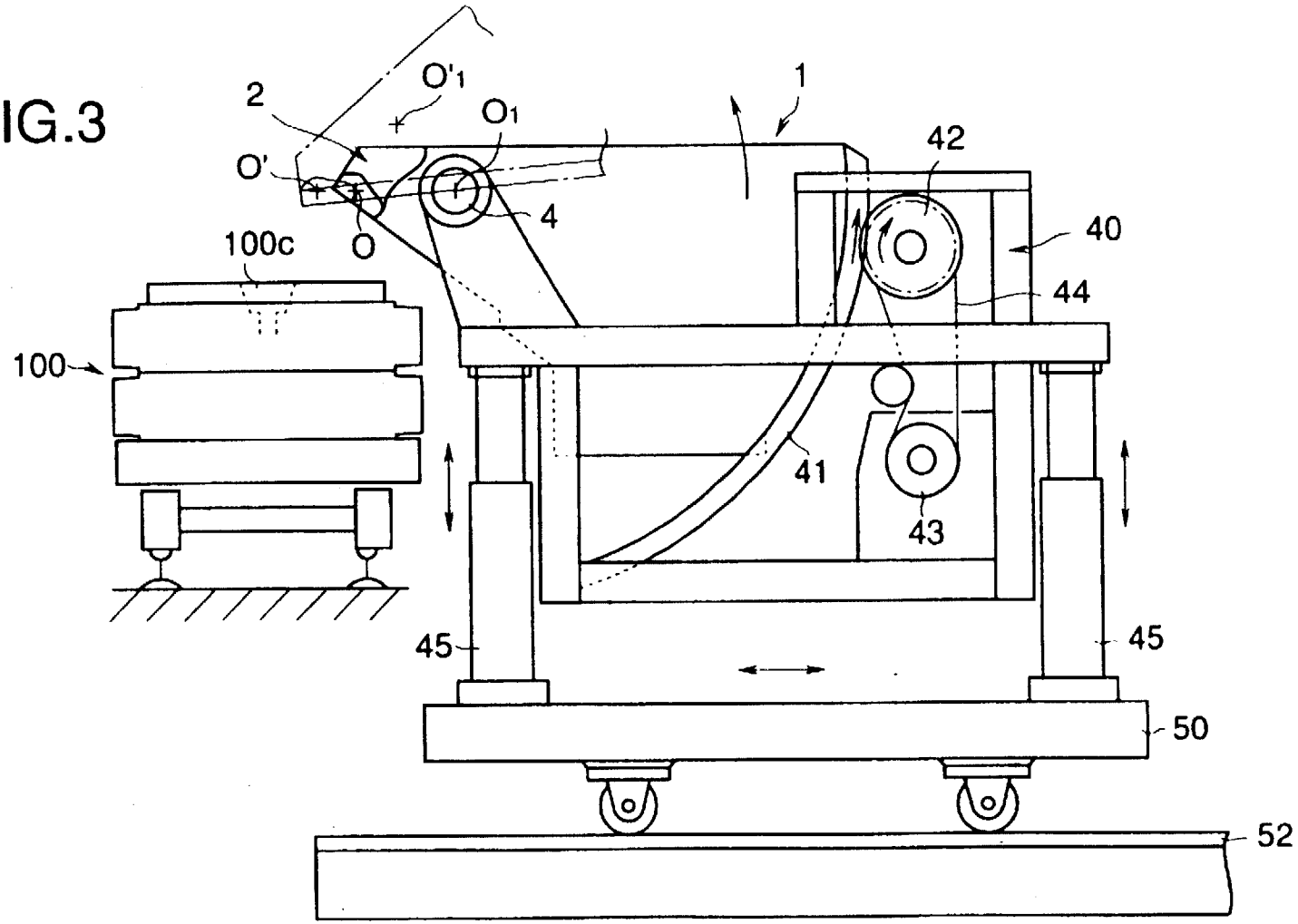
FIG. 3 is a side view of an embodiment of an apparatus for pouring molten metal according to the present invention.

First, referring to FIGS. 1 through 3, the principle of the invention is described.

Figure 6:
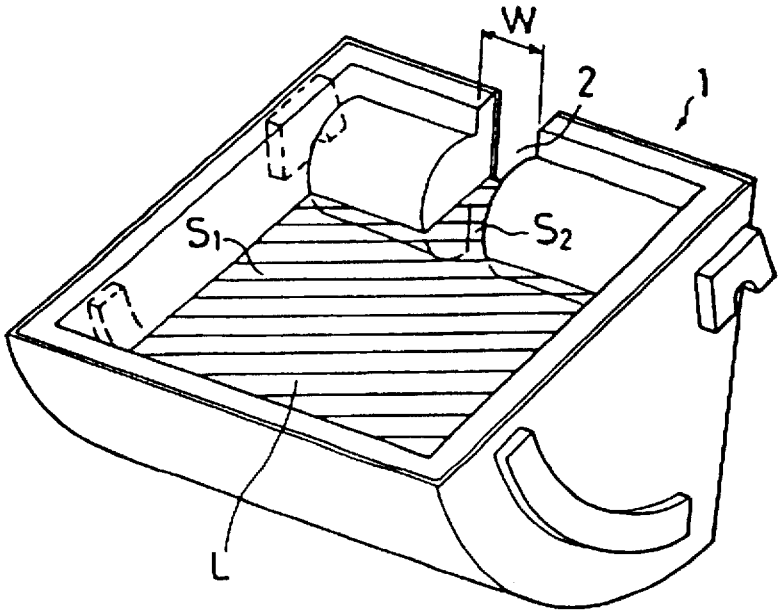
FIG. 6 is an isometric view of a conventional sector-shaped ladle.
Figure 7:
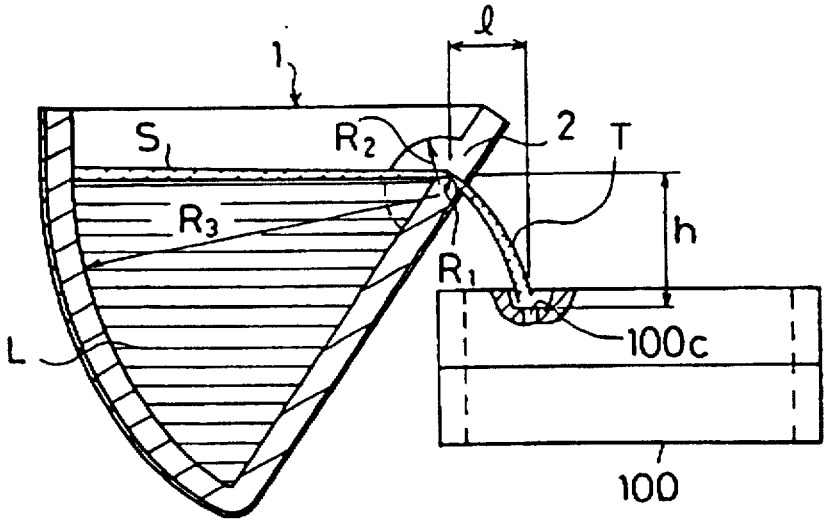
PRIOR ART FIG.7
FIG. 7 is a view illustrating a conventional method of pouring molten metal using the sector-shaped ladle.

Referring to FIG. 2, in this embodiment, a ladle 1 is a sector-shaped ladle as shown in FIG. 6 and FIG. 7, and has a reservoir 1A which can reserve a prescribed quantity of molten metal and a pouring spout 2 (generally called a "crow's mouth") connected with the molten metal reservoir 1A. Further, in this embodiment, in order to bear the ladle, a rotation shaft 4 is fixed to the ladle 1 in such a manner that the rotation shaft projects vertically outward from both sides of the ladle 1. The rotation shaft 4 is rotatably attached to the base 40 (see FIG. 3) of an apparatus for pouring molten metal and allows the ladle 1 to rotationally tilt around the rotation shaft 4.

The ladle 1 is rotationally tilted around the rotation shaft 4, and is driven and controlled so that the rotation center O' of the rotation shaft 4 moves along an arc locus R with its center at the imaginary initial pouring center O that is set at or adjacent to a molten metal falling start point at the top end of the pouring spout 2.

Accordingly, by the rotational tilting and arc movement of the ladle 1, the correlational position (1, h) of the molten metal falling start point at the top end of the pouring spout 2 and the pouring cup 100*c* of the mold is maintained constant, regardless of the movement of the ladle 1.

Further, as shown in FIG. 2, the position where the ladle 1 is tilted at an angle θ n from the horizontal position is the initial position, and the imaginary pouring center O at this time is the origin (0, 0). The vertical axis and the horizontal axis passing the imaginary pouring center O of the ladle 1 are the Z-axis and the Y-axis, respectively.

As illustrated in FIG. 2, when the ladle 1 is rotationally tilted counterclockwise at the angle θ about the rotation center $O_1$ of the ladle 1, the initial pouring center O moves from the origin to the center O'. Therefore, to make the pouring center O a fixed position, a control to return the moved center O' to the initial pouring center O may be conducted.

As shown in FIG. 2, an angle formed between the line which connects the rotation center $O_1$ of the ladle 1 and the pouring center O, and the horizontal line is the angle θ n as described above. When the distance between the rotation center $O_1$, of the ladle 1 and the pouring center O is Ln, the position (y, z) of the moved pouring center O' is expressed as:

$$y=Ln \cos \theta n-Ln \cos (\theta+\theta n)$$

$$z=Ln \sin (\theta+\theta n)-Ln \sin \theta n$$

Figure 4:
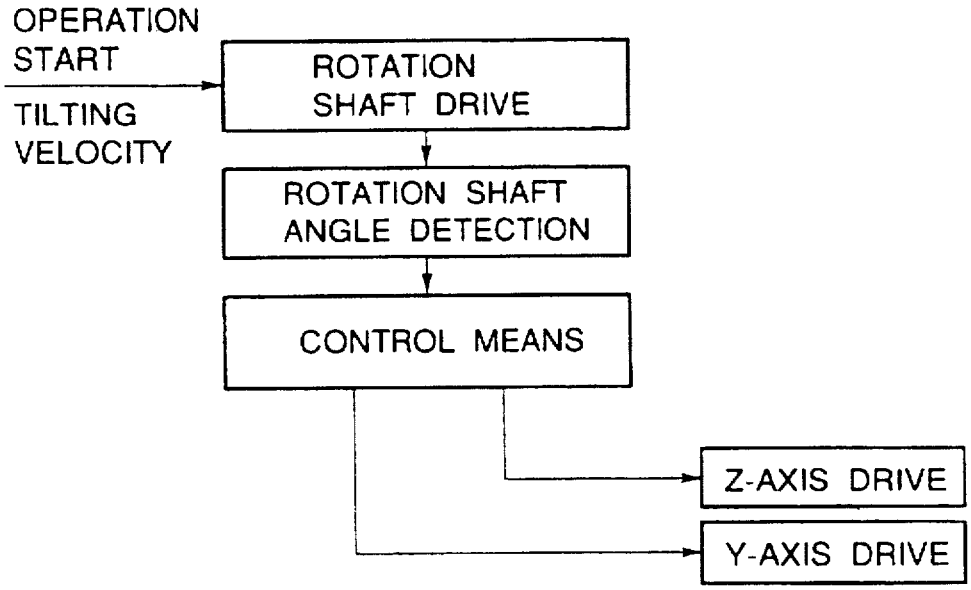
FIG. 4 is a drive control flow diagram for driving a ladle in accordance with the present invention.

Therefore, the ladle 1 is rotationally tilted at the angle θ about the rotation center $O_1$ of the ladle 1 and position-controlled in the Z-axis and Y-axis directions so that the rotation shaft 4 of the ladle 1, i.e., the center $O_1$, is moved such that the pouring center O takes the position (y, z), and thereby the positional relation (1, h) of the molten metal falling start point at the top end of the pouring spout 2 and the pouring cup of the mold is maintained constant irrespective of the movement of the ladle 1. That is, as shown in FIG. 4, the rotation shaft 4 is driven at a predetermined rotational tilting velocity by an operation starting signal. At the same time, the angle of the rotation shaft 4 is detected and the ladle 1 is position-controlled to drive it to the above-mentioned position (y, z) in the Z-axis and Y-axis directions according to the angle.

In the process of studying the method of pouring molten metal as constructed above, the inventors have found that when carrying out the above method it is difficult to pour the molten metal into a fixed position in the pouring cup of the mold. When the tilting of the ladle 1 increases, namely, when the tilting angle θ increases and the inclined front wall of the ladle 1 approaches the horizontal position, the molten metal that horizontally spouts increases its velocity as the ladle is tilted and tends to fall farther in the direction apart from the ladle 1.

Thus, according to the first embodiment of this invention, as shown in FIG. 1, the ladle 1 is rotationally tilted around its rotation shaft 4 and compensation controlled so that the rotation center $O_1$ of the rotation shaft 4 is moved along a locus $R_1$ which is deviated outward from the predetermined arc locus R with its center at the imaginary initial pouring center O that is set at or adjacent to the molten metal falling start point of the pouring spout 2 of the ladle at the start of the pouring. At the same time, the imaginary initial pouring center O of the pouring spout 2 is moved while maintaining a constant relationship with the rotation center $O_1$ of the rotation shaft 4, i.e., the constant distance Ln, whereby it is possible to pour the molten metal into the fixed position in the pouring cup of the mold, even though the pouring flow line varies due to the variation in the horizontal pouring velocity of the molten metal as the ladle is tilted.

On the other hand, with reference to the pouring spout 2, when the tilting angle of the ladle is small, the distance (area) along which the molten metal contacts the wall of the pouring spout is long, and when the tilting angle becomes large, the distance (area) along which the molten metal contacts the wall of the pouring spout is small. Accordingly, when the wetting property between the molten metal and the ladle (the affinity between the molten metal and the refractory material) is good, the molten metal falls farther from the ladle as the tilting angle increases. These phenomena are also largely affected by the viscosity of the molten metal.

Therefore, according to the second embodiment of this invention, as shown in FIG. 1, the ladle 1 is rotationally tilted around the rotation shaft 4 and compensation-controlled so that the rotation center $O_1$ of the rotation shaft 4 is moved along a locus $R_2$ which is deviated inward from the predetermined arc locus R with its center at the imaginary initial pouring center O that is set at or adjacent to the molten metal falling start point of the pouring spout 2 of the ladle at the start of the pouring. At the same time, the imaginary initial pouring center O is moved while maintaining a constant relationship with the rotation center $O_1$ of the rotation shaft 4, namely the constant distance Ln, whereby, it is possible to pour the molten metal to the fixed position of the pouring cup in the mold, though the pouring flow line varies due to the influence of the wetting property of the molten metal according to the tilting motion of the ladle.

As seen from the above, according to this invention, in the case where the influence of the horizontal pouring velocity is more than that of the wetting property, the ladle 1 is position-controlled according to the above-mentioned first embodiment, namely along the locus $R_1$. On the other hand, in the case where the influence of the horizontal pouring velocity is less than that of the wetting property, the ladle 1 is position-controlled according to the above-mentioned second embodiment, namely along the locus $R_2$.

Moreover, according to this invention, the imaginary initial pouring center O of the pouring spout 2 of the ladle 1 is moved downward along a locus $V_1$ to approach the pouring cup 100*c* of the mold until the ladle 1 is rotationally tilted about the rotation shaft 4 at the predetermined angle, i.e., a titling angle of 8° in this embodiment, from the start of the pouring of the molten metal (the tilting angle being 0°). Afterward, the imaginary initial pouring center O is moved in the horizontal direction along a locus $H_1$ to leave the mold 100 between a tilting angle of 8° and 50° in this embodiment. This is applied to a case where the influence of the horizontal pouring velocity is more than that of the wetting property.

If the influence of the horizontal pouring velocity is less than that of the wetting property, until the ladle 1 is rotationally tilted about the rotation shaft 4 by the predetermined angle, i.e., a titling angle of 8° in this embodiment, from the start of pouring of the molten metal (the tilting angle being 0°), like the above embodiment, the imaginary initial pouring center O of the pouring spout 2 of the ladle 1 is moved downward along a locus $V_2$ to approach the pouring cup 100*c* of the mold. Afterward, in this embodiment, the imaginary initial pouring center O is moved in the horizontal direction along a locus $H_2$ to approach the mold 100 at a tilting angle between 8° and 50°.

FIG. 3 shows an embodiment of the apparatus for pouring molten metal according to this invention. As described above in conjunction with FIG. 1 and FIG. 2, the ladle 1 is attached to the base 40 in such a manner that the ladle 1 can rotate about the rotation shaft 4. In this embodiment, the ladle 1 integrally has a sector gear 41 which has its center at the rotation center $O_1$ of the rotation shaft 4. The sector gear 41 is engaged with a drive gear 42. The drive gear 42 is driven by drive means 43 which is installed in the base 40 via a transmission mechanism 44 such as a belt, a chain, or the like.

A dolly 50 is mounted on the base 40 preferably through hydraulic cylinders 45. Accordingly, by operating the hydraulic cylinders 45, the base 40 or the ladle 1 is moved up and down. The hydraulic cylinder may be replaced by other means, for example a ball spiral mechanism. The dolly 50 is equipped with drive means (not shown) and is able to run by itself on rails 52 to thereby cause the ladle 1 to come close to and depart from the mold 100.

In such a construction, when pouring the molten metal, the ladle 1 itself is rotated around the rotation shaft 4 as descried above. In addition, the above-mentioned hydraulic cylinders 45 and the dolly 50 are drive-controlled in the vertical and horizontal directions (the up and down, and right and left directions in the drawing) in such a manner that the rotation center $O_1$, of the rotation shaft 4 of the ladle 1 and the imaginary pouring center O move along the loci $R_1$ ($R_2$), $V_1$ ($V_2$), and $H_1$ ($H_2$).

The apparatus for pouring molten metal according to this invention is capable of pouring the molten metal into the fixed position in the pouring cup of the mold by rotational-tilting, vertical and horizontal movements of the ladle 1, even though the pouring position of the molten metal varies as the ladle is tilted.

EXAMPLE 2

Figure 5:
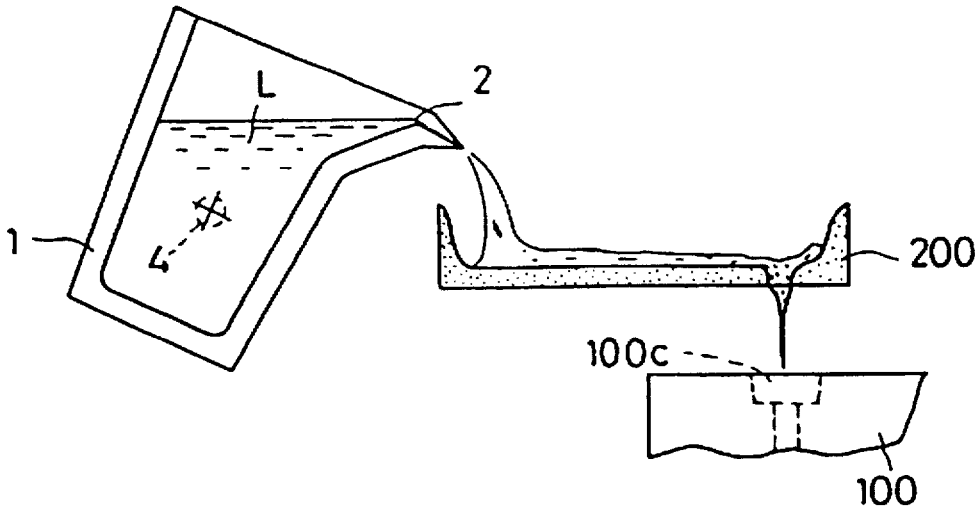
FIG. 5 shows a conventional method of pouring molten metal.

Although the ladle has been described in Example 1 as being sector-shaped, it should be appreciated that it is possible to use a ladle of any suitable shape. For example, as shown in FIG. 5, the ladle 1 can take a near cylindrical shape. In this case, the pouring quantity of the molten metal from the ladle can be controlled to be constant by compensating the tilting velocity of the ladle according to variations in the surface area.

Figure 8:
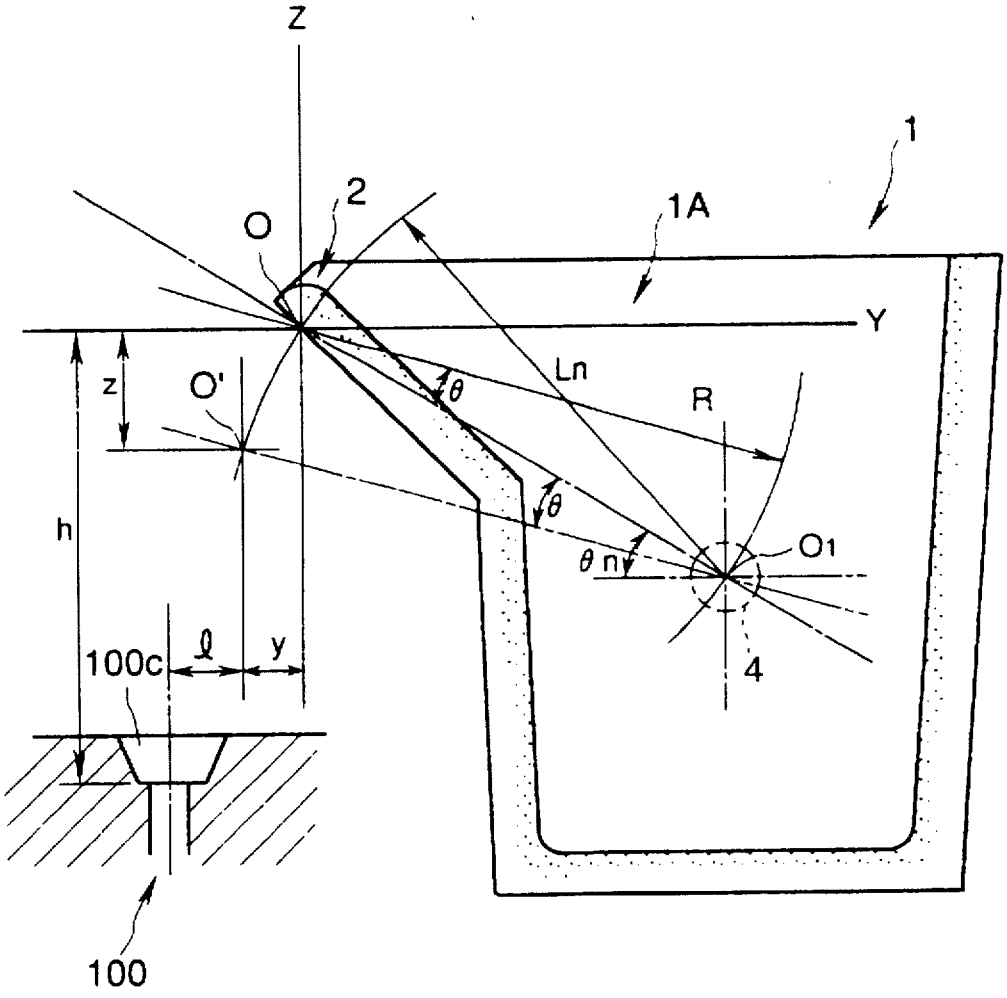
FIG. 8 is a view illustrating a principle of a method of pouring molten metal using a cylindrical ladle according to the present invention.
Figure 9:
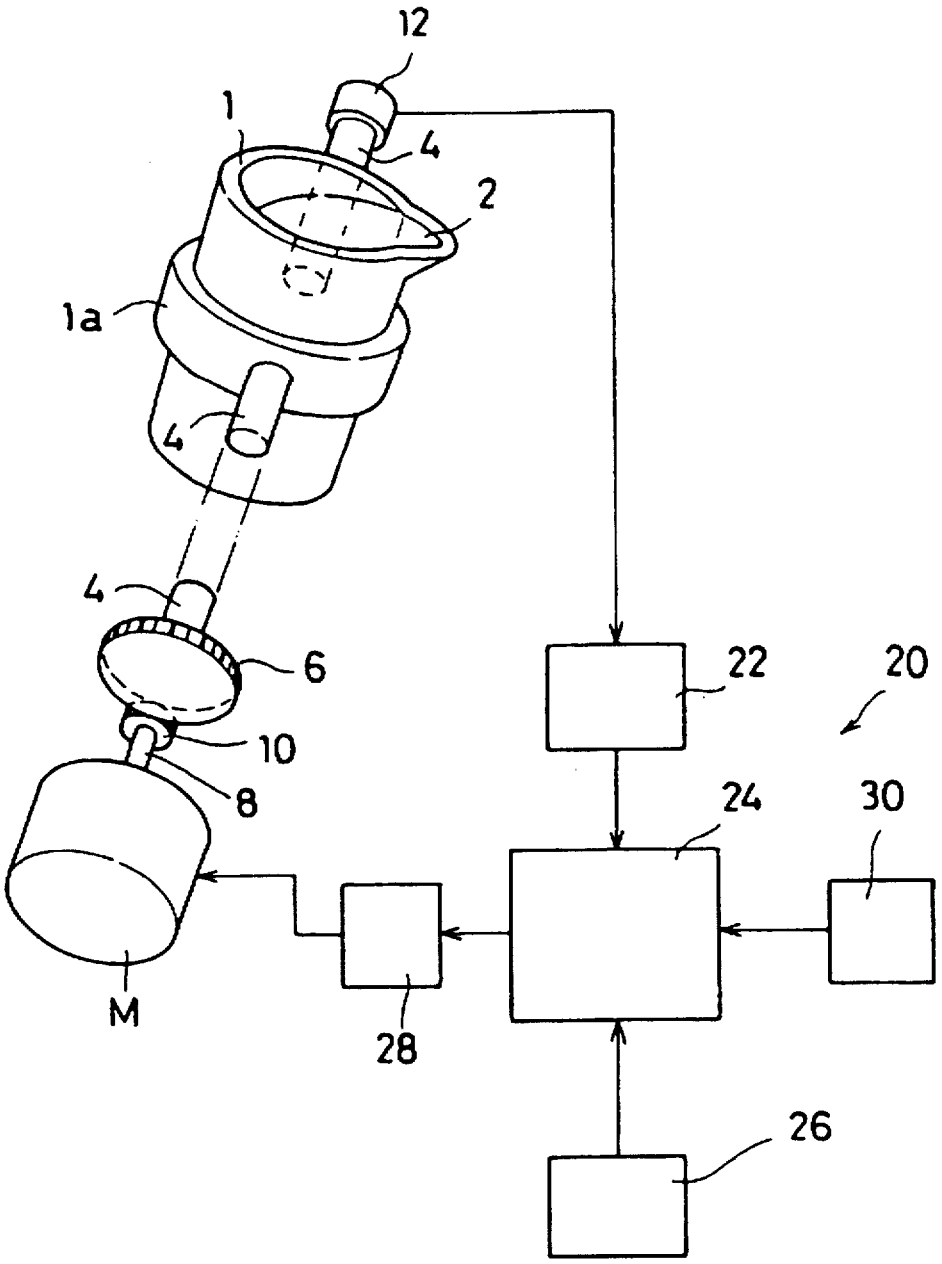
FIG. 9 is a perspective view illustrating an embodiment of a method of pouring molten metal using the cylindrical ladle.

With reference to FIG. 8, in this embodiment, the ladle 1 is preferably a cylindrical ladle similar to that shown in FIG. 5. Like the sector-shaped ladle in Example 1, the ladle 1 has a reservoir 1A which can reserve a prescribed quantity of molten metal. The ladle also has a pouring spout 2 connected with the molten metal reservoir 1A. Further, in this embodiment, a rotation shaft 4 to bear the ladle is fixed to the ladle 1 in such a manner that the rotation shaft projects vertically outward from both sides of the ladle 1. This rotation shaft 4 is rotatably attached to the base 40 of an apparatus (see FIG. 3) for pouring molten metal and allows the ladle to rotationally tilt around the rotation shaft 4.

Also, in the this embodiment, the ladle 1 is rotationally tilted around the rotation shaft 4 and is basically drive-controlled in such a manner that the rotation center $O_1$ of the rotation shaft 4 moves along an arc locus R with its center at an imaginary initial pouring center O that is set at or adjacent to a molten metal falling start point at a top end in the pouring spout 2.

Accordingly, by the rotational tilting and arc movement of the ladle 1, the correlational position (1, h) of the molten metal falling start point at the top end of the pouring spout 2 and the pouring cup 100c of the mold is maintained constant regardless of the movement of the ladle 1.

As shown in FIG. 8, the position where the ladle 1 is tilted at an angle θn from the horizontal position is the initial position and the imaginary pouring center O at this time is the origin (0, 0) in this embodiment. The vertical axis and the horizontal axis passing the imaginary pouring center O of the ladle 1 are the Z-axis and the Y-axis, respectively.

In FIG. 8, when the ladle 1 is rotationally tilted counter-clockwise at the angle θ about the rotation center $O_1$ of the ladle 1, the initial pouring center O positioned at the origin moves to the center O'. Therefore, to make the pouring center O a fixed position, a control to return the moved center O' to the initial pouring center O is made.

As shown in FIG. 8, the angle formed between the line connecting the rotation center $O_1$ of the ladle 1 and the pouring center O and the horizontal line is the angle θn as described above. When the distance between the rotation center $O_1$ of the ladle 1 and the pouring center O is Ln, the position (y, z) of the moved pouring center O' is expressed as:

$$y=Ln\cos(\theta n-\theta)-Ln\cos\theta n$$

$$z=Ln\sin\theta n-Ln\sin(\theta n-\theta)$$

Therefore, the ladle 1 is rotationally tilted at angle θ about the rotation center $O_1$ of the ladle 1 and position-controlled in the Z-axis and Y-axis directions so that the rotation shaft 4 of the ladle 1, that is, the center $O_1$, takes the position (y, z) mentioned above, and thereby the positional relation (1, h) of the molten metal falling start point at the top end in the pouring spout 2 and the pouring cup of the mold is maintained constant irrespective of the movement of the ladle 1.

That is, as shown in FIG. 8, the rotation shaft 4 is driven at a predetermined rotational tilting velocity by an operation starting signal. At the same time the angle of the rotation shaft 4 is detected and the ladle 1 is position-controlled to drive it to the above-mentioned position (y, z) in the Z-axis and Y-axis directions according to the angle.

Further, according to the present invention, similar to Example 1, as shown in FIG. 1, the ladle 1 is rotationally tilted around its rotation shaft 4 and simultaneously compensation-controlled in such a manner that the rotation center $O_1$, of the rotation shaft 4 is moved along a locus $R_1$ which is deviated outward from the predetermined arc locus R with its center at the imaginary initial pouring center O that is set at or adjacent to the molten metal falling start point of the pouring spout 2 of the ladle at the start of the pouring. At the same time, the imaginary initial pouring center O of the pouring spout 2 is moved while maintaining a constant relationship with the rotation center $O_1$ of the rotation shaft 4, i.e., the constant distance Ln, whereby it is possible to pour the molten metal into the fixed position in the pouring cup of the mold , even though the pouring flow line varies due to variation in the horizontal pouring velocity of the molten metal as the ladle is tilted.

Alternatively, according to another embodiment of this invention, as shown in FIG. 1, the ladle 1 is rotationally tilted around the rotation shaft 4 and compensation-controlled in such a manner that the rotation center $O_1$, of the rotation shaft 4 is moved along a locus $R_2$ which is deviated inward from the predetermined arc locus R with its center at the imaginary initial pouring center O that is set at or adjacent to the molten metal falling start point of the pouring spout 2 of the ladle at the start of the pouring. At the same time, the imaginary initial pouring center O is moved while maintaining a constant relationship with the rotation center $O_1$ of the rotation shaft 4, i.e., the constant distance Ln, whereby it is possible to pour the molten metal into the fixed position of the pouring cup in the mold, even though the pouring flow line varies due to the influence of the wetting property of the molten metal as the ladle is tilted.

Therefore, in the case where the influence of the horizontal pouring velocity is more than that of the wetting property, the ladle 1 is position-controlled along the locus $R_1$. On the other hand, in the case where the influence of the horizontal pouring velocity is less than that of the wetting property, the ladle 1 is position-controlled along the locus $R_2$.

Further, as the case may be, the position-control of the ladle 1 may be conducted by mixing the control of the above loci $R_1$ and $R_2$. However, this will be limited to the case where the locus of the pouring flow line non-linearly varies due to the nature of the molten metal.

The imaginary initial pouring center O of the pouring spout 2 of the ladle 1 is moved downward along the locus $V_1$ to approach the pouring cup 100*c* of the mold as shown in FIG. 1, until the ladle 1 is rotationally tilted about the rotation shaft 4 at the predetermined angle, i.e., a titling angle of 8° in the this embodiment, from the start of the pouring of the molten metal (the tilting angle being 0°). Afterward, the imaginary initial pouring center O is moved in the horizontal direction along the locus $H_1$ to leave the mold 100 at a tilting angle of from 8° to 50° in this embodiment. This is applicable to a case where the influence of the horizontal pouring velocity is more than that of the wetting property.

If the influence of the horizontal pouring velocity is less than that of the wetting property, similar to the previous embodiment, the imaginary initial pouring center O of the pouring spout 2 of the ladle 1 is moved downward along the locus $V_2$ to approach the pouring cup 100*c* of the mold as shown in FIG. 1, until the ladle 1 is rotationally tilted about the rotation shaft 4 by the predetermined angle, i.e., a titling angle of 8° in this embodiment, from the start of the pouring of the molten metal (the tilting angle being 0°). Afterward, in this embodiment, the imaginary initial pouring center O is moved in the horizontal direction along the locus $H_2$ to approach the mold 100 between a tilting angle of 8° and 50°.

As previously mentioned, in the case of using the cylindrical ladle 1 as in this embodiment, the surface area in the ladle varies as the ladle is tilted, and thus if the pouring operation is carried out at a constant tilting speed, it is impossible to conduct the pouring of the molten metal at a constant flow rate. Therefore, in such case, the pouring flow rate of the molten metal from the ladle can be controlled to become always constant by compensating the tilting velocity of the ladle according to variations in the surface area. An embodiment of the control is described hereafter.

Referring to FIGS. 9 through 12, a rotation shaft 4 is fixed to a support la formed at the middle portion of the ladle 1 with the rotation shaft 4 being projected vertically outward from the ladle 1. The rotation shaft 4 is rotatably attached to the base 40 (see FIG. 3).

In this embodiment, a drive gear 6 is fixed to the rotation shaft 4. The drive gear 6 is engaged with a drive gear 10 fixed to an output shaft 8 of the servo motor M as drive means. On the rotation shaft 4 of the ladle 1 is integrally provided an angle detecting means, for example a potentiometer 12, for detecting the rotation angle of the rotation shaft 4 of the ladle 1. The ladle 1 is also provided with rotation control means 20 (described in greater detail hereafter).

Analog signals detected by the angle detecting means 12 are converted to digital signals through an A–D converter 22 and are sent to a memorizing and computing device (memory and arithmetic logic unit) 24. The variation rate of the surface area of the ladle 1 to the tilting angle of the ladle 1 as used has previously been memorized in the memorizing and computing device 24. The tilting velocity of the ladle is computed and compensated with the signals from the angle detecting means 12, the signals from a velocity command device 26, and the above-mentioned memorized signals, which are input into the memorizing and computing device 24. As for the memorizing method, as mentioned above, the variation in the cross sectional area of the inside of the ladle is calculated and input into the memorizing device. Alternatively, there is a memorizing method based on a teaching play back system in which the relationship between the tilting angle and the pouring velocity and time period in the pouring operation is determined by actually pouring the molten metal for one ladle into the mold.

The velocity of the ladle is compensated such that the flow rate of the molten metal as spouted out from the ladle 1 is maintained constant during the pouring of the molten metal into the mold. The compensated velocity signals of the ladle 1 are sent to ladle drive means, e.g., the servo motor M mentioned above, through velocity conversion means, e.g., a D–A converter 28. Moreover, a compensation input device 30 for writing and rewriting the memorized signals in the memorizing and computing device 24 or the computing-coefficients for compensating the velocity, etc. is provided.

The operating manner of the pouring apparatus with the construction as mentioned above is described hereafter in more detail by way of example. When the velocity signals output from the pouring velocity command device 26 are input into the memorizing and computing device 24, the velocity signals are compensated by the velocity compensation signals memorized in the memorizing and computing device 24, and are transmitted to the ladle drive means M through the velocity signal conversion means 28 to control the drive means M. The surface area of the ladle 1 as used varies according to the tilting angle of the ladle 1. Such signals are memorized in the memorizing and computing device as the compensating coefficients.

Figure 10:
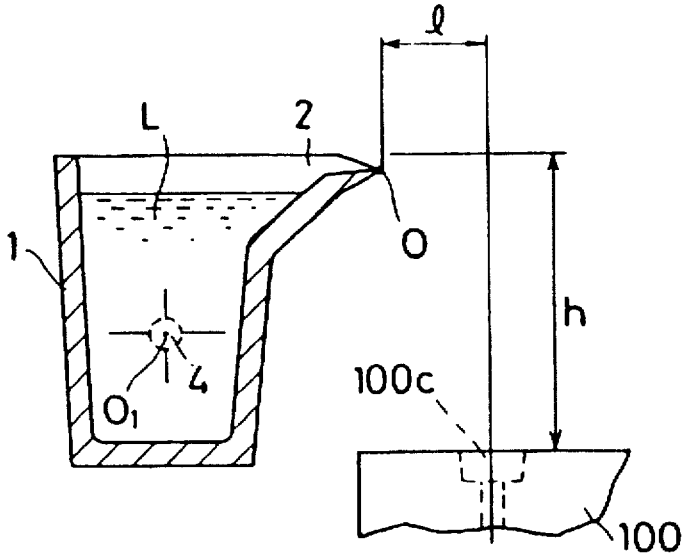
FIG. 10 is a view illustrating the method of pouring molten metal as shown in FIG. 9.
Figure 11:
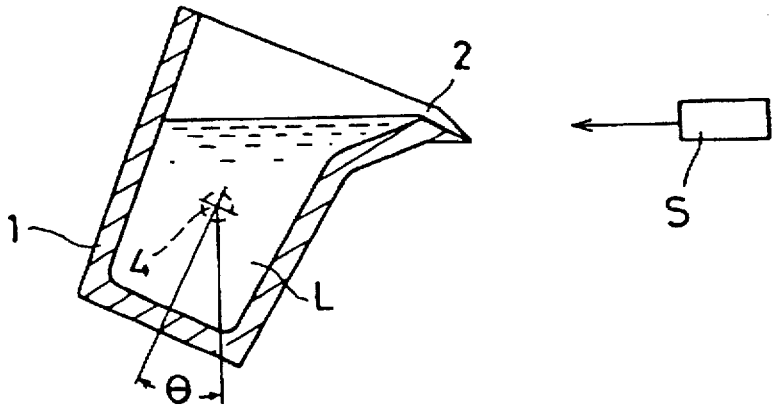
FIG. 11 is another view illustrating the method of pouring molten metal as shown in FIG. 9.
Figure 12:
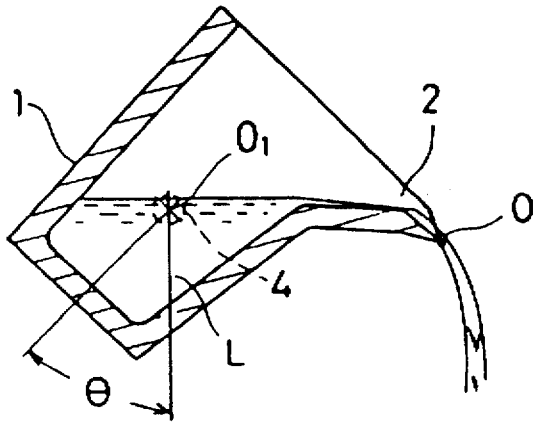
FIG. 12 is a further view illustrating the method of pouring molten metal as shown in FIG. 9.

The ladle 1 in the position as shown in FIG. 10 starts its tilting motion upon the depression of an operation start button (not shown). As for the velocity of the ladle, the rotation velocity of the ladle is adjusted according to the variations in the rotation angle or weight. At the same time, as shown in FIG. 1, the center $O_1$ of the rotation shaft 4 of the ladle 1 is controlled to move along the predetermined arc locus $R_1$ or $R_2$, and the imaginary initial pouring center O is controlled to move while maintaining a constant relationship with the rotation center of the rotation shaft 4.

Simultaneously with the start of the tilting of the ladle, position detecting means (not shown) confirm that the position of the pouring cup of the mold has a predetermined positional relation to the pouring point of the ladle, whereupon the signal of GO is output. Namely, when the pouring cup of the mold has a predetermined positional relation to the pouring point, the pouring is started. A pouring detecting sensor S confirms the pouring the moment the molten metal is spouted out from the pouring spout of the ladle. At the same time, the velocity signals from the velocity command device 26 are compensated to an optimum velocity according to the position of the tilting of the ladle, and transmitted to the ladle drive means M through the velocity signal conversion means 28 to attain the predetermined tilting velocity. When the quantity of the molten metal for one ladle (confirmed by the weighing variation) is discharged, the ladle is tilted back at a maximum velocity in the opposite direction to the precedent rotational direction to smoothly cut off the pouring. The tilting-back motion of the ladle is stopped at a fixed angle (at the position where the molten metal does not spill from the ladle mouth 2).

According to a continuous tact cycle time, when the subsequent mold is set at a fixed position, the pouring operation is repeated according to the procedures described above. Such a pouring operation is continuously made until the molten metal in the ladle 1 becomes less than that for one ladle.

In the above-mentioned embodiment the rotation angle of the ladle 1 has been used as the parameter for compensating the velocity of the memorizing and computing device 24. However, in the automatic pouring apparatus as shown in FIG. 3 which is equipped with a weighing device for continuously measuring the weight of the ladle 1, it is possible to input variations in the weight of the content of the ladle, i.e., the output signals from the weighing device (load cell), into the memorizing and computing device 24 as the parameter.

As mentioned above, according to the present invention even if any ladle shape is employed, that is, even if the surface area inside the ladle varies as the ladle tilts, as the tilting velocity of the ladle is compensated corresponding to such variation in the surface area, the flow rate of the molten metal from the ladle becomes constant to thereby accomplish safe, exact, and economical pouring.

EXAMPLE 3

According to the present invention, as mentioned above, in the case where the flow line locus varies in a non-linear manner due to the characteristics of molten metal, it is possible to control the position of the ladle by mixing the control of the above-mentioned loci $R_1$ and $R_2$. Moreover, as described, when cutting off the pouring to finish the molten metal pouring operation, the cut-off of the pouring can be done quickly by destroying the control relations between the tilting motion on the rotation center $O_1$ of the ladle 1 and the movements along the Z-axis and Y-axis, for example, by suspending drive in the Z-axis direction, or by making the movement along the Z-axis larger than a specified value.

Further, according to still another embodiment, when starting the pouring of the molten metal, by destroying the control relations between the tilting motion on the rotation center $O_1$ of the ladle 1 and the movements along the Z-axis and Y-axis, by making the movement along the Y-axis larger than a specified value, and, by making the movement along the Y-axis smaller than the specified value, when finishing the pouring of the molten metal, it is possible to delay a retracting movement of the ladle 1 from the mold 100. According to this method, it is possible to effectively prevent the molten metal that sags from the spout 2 of the ladle 1 from falling to positions other than the cup 100*c* of the mold 100. If the cup diameter of the mold 100 is approximately 100 mm, depending on the distance between the spout 2 and the cup 100*c*, the amount of deviation from the specified value may generally be 30 to 40 mm.

As described above, according to this invention, since the ladle is rotationally tilted on the rotation shaft and the rotation center $O_1$ of the rotation shaft is moved along the locus which is deviated from the prescribed arc locus with its center at the imaginary initial pouring center O that is set at or adjacent to the molten metal falling start point of the ladle spout, and, at the same time, the imaginary initial pouring center O of the spout is moved while maintaining the fixed relationship with the rotation center $O_1$ of the rotation shaft, whereby the molten metal is poured to the fixed position of the mold cup irrespective of variations in the pouring flow line of the molten metal as the ladle tilts, even when the spout and the mold cup are very close to each other, or even when the flow rate and flow velocity of the molten metal from the ladle to the mold vary as the ladle tilts, or further, even when the pouring flow line of the molten metal from the ladle to the mold varies due to the characteristics (the wetting property or the viscosity) of the molten metal, it is possible to pour the molten metal into the fixed position of the mold cup and thereby realize very safe and accurate pouring of molten metal.

What is claimed is:

1. A method of pouring molten metal into a mold comprising the steps of:

rotationally tilting a ladle containing molten metal about a rotation shaft of the ladle;

moving a rotation center of the rotation shaft along a locus deviating from a predetermined arc locus with its center at an imaginary initial pouring center which is set at or adjacent to a molten metal falling start point in a pouring spout of the ladle when pouring of the molten metal begins; and simultaneously moving the imaginary initial pouring center of the spout while maintaining a fixed relationship with the rotation center of the rotation shaft;

wherein the molten metal is poured to a fixed position in a pouring cup of the mold, even though a pouring flow line of the molten metal varies as the ladle moves.

2. A method of pouring molten metal according to claim 1, wherein said ladle is rotationally tilted about the rotation shaft and driven in a vertical direction and in a horizontal direction to thereby move along said predetermined locus.

3. A method of pouring molten metal according to claim 1, wherein the imaginary initial pouring center of the spout is moved downward to approach the mold until the ladle is tilted at a predetermined angle about the rotation shaft after pouring of the molten metal begins, and then moved horizontally toward or away from the mold.

4. A method of pouring molten metal according to claim 1, wherein, under a condition where the influence of a horizontal pouring velocity of the molten metal is more than that of a wetting property between the molten metal and the ladle, the rotation center of the rotation shaft is moved along a locus deviating outward from the predetermined arc locus which has its center at the imaginary initial pouring center of the spout, and the imaginary initial pouring center of the spout is simultaneously moved downward to approach the mold until the ladle is rotationally tilted at the predetermined angle about the rotation shaft after pouring of the molten metal begins, and then moved horizontally away from the mold.

5. A method of pouring molten metal according to claim 1, wherein, under a condition where the influence of a horizontal pouring velocity of the molten metal is less than that of a wetting property between the molten metal and the ladle, the rotation center of the rotation shaft is moved along a locus deviating inward from the predetermined arc locus which has its center at the imaginary initial pouring center of the spout, and the imaginary initial pouring center of the spout is simultaneously moved downward to approach the mold until the ladle is rotationally tilted at the predetermined angle about the rotation shaft after pouring of the molten metal begins, and then moved horizontally toward the mold.

* * * * *